United States Patent [19]

Nordstrom

[11] 4,332,991

[45] Jun. 1, 1982

[54] ELECTRICAL TOGGLE SWITCH

[76] Inventor: Arnold B. Nordstrom, 3855 Paseo de las Tortugas, Torrance, Calif. 90505

[21] Appl. No.: 216,065

[22] Filed: Dec. 12, 1980

[51] Int. Cl.[3] ..... H01H 5/18; H01H 3/04

[52] U.S. Cl. ..... 200/67 G; 200/339

[58] Field of Search ..... 200/67 G, 68, 315, 339

[56] References Cited

U.S. PATENT DOCUMENTS

| | | | |
|---|---|---|---|
| 2,681,962 | 6/1954 | Sundt | 200/339 |
| 3,403,236 | 9/1968 | Zuludon | 200/676 |
| 3,582,584 | 6/1971 | Best | 200/339 |
| 3,641,291 | 2/1972 | Carling | 200/67 G |
| 3,673,368 | 6/1972 | Howe et al. | 200/67 G |
| 4,095,070 | 6/1978 | Simpson | 200/67 G |
| 4,117,284 | 9/1978 | Kirchoff et al. | 200/67 G |

*Primary Examiner*—John W. Shepperd

*Attorney, Agent, or Firm*—John Holtrichter, Jr.

[57] ABSTRACT

There is herein described an electrical switch which is manually or mechanically moved from one position to another in order to change the electrical conductivity between one or more of its terminals and one or more of the other of its terminals, the invention including a unique member that is deformed by the manipulation of an actuation member and that toggles into a stable and less deformed configuration to make the desired electrical contacts.

8 Claims, 8 Drawing Figures

Fig. 6.
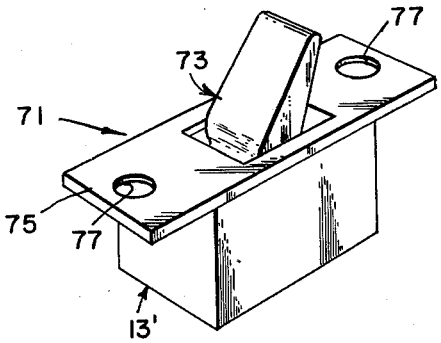
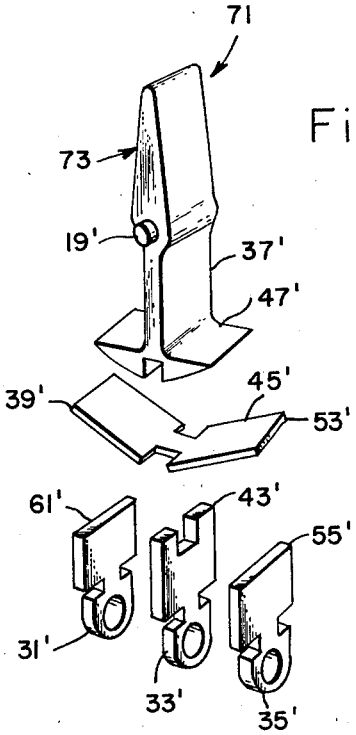
Fig. 7.
Fig. 8.
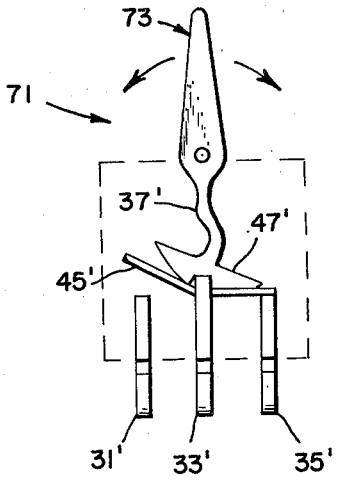

ELECTRICAL TOGGLE SWITCH

TECHNICAL FIELD

This invention relates to the field of electrical switches and more particularly to electrical toggle switches.

BACKGROUND ART

Electrical toggle-type switches are well known in the electrical art and their construction has not changed drastically over the years.

Probably the most modern mechanical configuration to provide the toggle action is the use of a switch lever that includes a hollow tubular portion extending within the switch housing, which hollow portion carries a spiral spring that provides a bias force on a round-ended plastic plunger partially housed at the end of the tubular portion. The plunger may ride on a pivotal contact plate which includes a detent or depression at its opposite ends so that the only stable positions for the lever are those where the plunger sits in one of the detents. In one case, the contact plate provides electrical continuity between a central contact member on which the plate pivots and on another contact member on one side thereof. In the other case, the contact plate is caused to pivot by the movement of the lever so that the control contact member now provides an electrical conduction path to another contact member located on the opposite side of the central contact.

Although this prior art configuration seems to be simple enough, it should be realized that hundreds of thousands of these switches are manufactured each year because of a continuing need for toggle-type switching and, therefore, a technique which will reduce the number of components will greatly reduce the cost of materials and labor to fabricate these switches. It should also be realized that by reducing the number of components an article of manufacture requires will reduce the number of components that may fail in operation of the device and will thus increase the reliability of the product and, thus, would be considered as a significant advancement of the art.

SUMMARY OF THE INVENTION

In view of the foregoing factors and conditions characteristic of the prior art, it is a primary object of the present invention to provide a new and improved electrical toggle switch.

Another object of the present invention is to provide an electrical toggle switch having fewer components than prior art switches of the same type.

Still another object of the present invention is to provide a simple-to-construct toggle-type electrical switch that is reliable in operation and has only two moving parts.

Yet another object of the present invention is to provide an electrical toggle switch that may be manually or mechanically moved to either of two stable positions and that may make or break one or more electrical circuits simultaneously.

In accordance with an embodiment of the present invention, an electrical switch is provided that includes a switch housing with a mounting portion and a plurality of spaced electrical switch contacts mounted in the switch housing. A conductive contact member is pivotally mounted in the housing on a first of the switch contacts and is movable to either of two opposite pivotal positions to selectively make electrical contact with others of the contacts on opposite sides of the first switch contact. Also included is a switch lever having two operating positions and has a manipulatable portion, a lower end portion operatively coupled to the conductive contact member opposite the first switch contact, and an intermediate pivot operatively coupled to the switch housing. That portion of the lever between the pivot and the lower end portion is resiliently bendable and has two oppositely bowed stable positions a range of unstable positions intermediate the stable positions. Each of the stable positions corresponds to a different one of the switch lever operating positions, the movement of the switch lever from one of the operating positions to the other thereof causing the contact member to move to a different one of the pivotal positions.

The toggle switch may include a paddle-type lever or a rocker-type lever, and is configurable into a two-position electrical switch with any number of poles (electrical circuits). Also, the housing may include flanges for mounting to panels and the like, or may include other types of fastening means, snap-in type mountings, for example.

The features of the present invention which are believed to be novel are set forth with particularity in the appended claims. The present invention, both as to its organization and manner of operation and use, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 6 is a perspective view of another embodiment of the present invention wherein the manipulatable portion of the switch lever is in the form of a paddle;

FIG. 7 is an enlarged, exploded view, of the principal moving elements of the invention shown in FIG. 6; and FIG. 8 is a front elevational view of the switch shown in FIG. 6, showing the paddle switch lever in its unstable configuration.

DESCRIPTION OF THE PREFERRED EMBODIMENT

Figure 1:
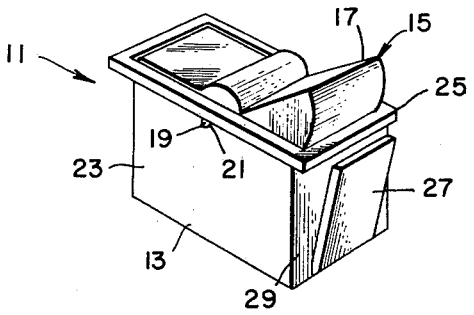
FIG. 1 is a perspective view of the electrical toggle switch constructed in accordance with the present invention.
Figure 2:
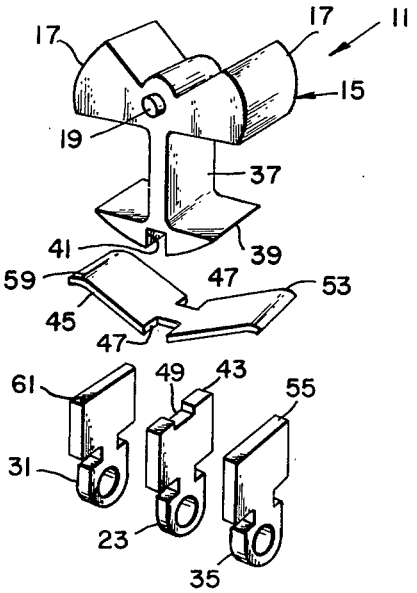
FIG. 2 is an enlarged, exploded view, of the principal moving elements of the present invention, as shown in FIG. 1.

Referring now to the drawings and more particularly to FIGS. 1–5, there is shown an electrical toggle switch 11 including a switch housing 13 of any conventional and preferably non-electrical conducting material, such as for example a plastic material. In this embodiment, the invention includes a rocker-type actuator member 15, the upper portion of which has two rocker lobes 17 and a pivot 19 located generally therebetween, the pivot 19 being journaled in appropriately positioned holes 21 in opposite side walls 23 of the housing 13.

This embodiment provides a mounting flange portion 25 extending from an upper edge of the housing 13 and also provides cooperating flexible tab members 27 extending from the bottom of housing end walls 29 toward the flange portion 25. The switch 11 may thus easily be mounted in a rectangular panel opening (not shown) that is dimensioned slightly less than the dimensions of the flange portion, 25 by inserting the bottom of the housing through the opening causing the tab members 27 to bend toward the housing until the flange portion 25 is adjacent the panel and the panel is just beyond the ends of the tab members. This allows the latter members to return to their normal configuration behind the panel to thereby hold the switch housing in this position.

Figure 3:
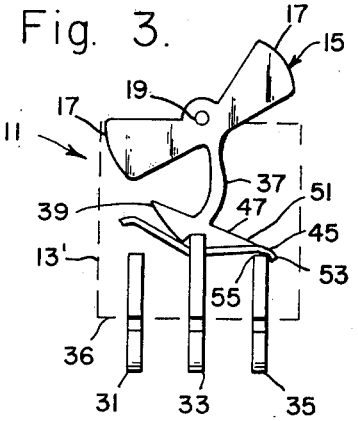
FIG. 3 is a front elevational view of the switch of FIG. 1, showing the switch lever in one of its stable bowed position.
Figure 4:
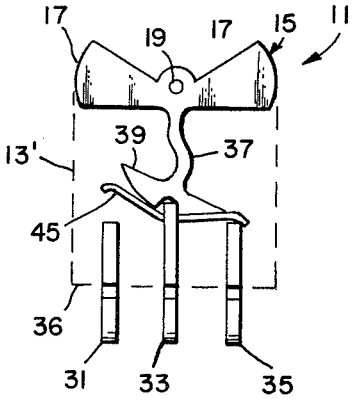
FIG. 4 is a front elevational view of the switch of FIG. 1, showing the switch lever in its unstable range of positions.
Figure 5:
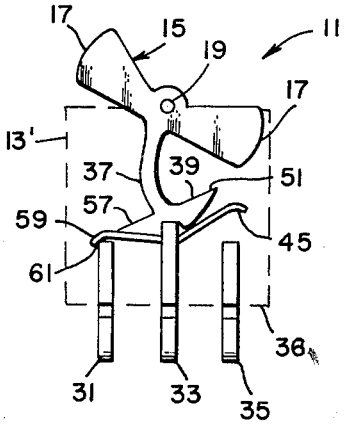
FIG. 5 is similar to the previous illustrations, but showing the switch lever in its other stable bowed position.

For the sake of clarity, the housing 13 is not shown in detail in FIGS. 2–5, but is generally represented in FIGS. 3–5 by dashed lines 13'. A plurality of spaced electrical contacts 31, 33, 35 are mounted in a bottom wall 36 of the housing 13 and extend below the bottom wall where electrical connection to external wiring (not shown) may be made in any conventional manner.

As most clearly seen in FIGS. 3–5, the center contact 33 is generally in vertical alignment with the pivot 19, and the actuator member 15 also includes a stem portion 37 which terminates at its interior or bottom extremity at a stem flange portion 39.

The stem flange portion 39 includes a notch 41 which registers with the upper end 43 of the center contacts 33. Disposed between and in contact with both the stem flange portion 39 and the upper end 43 of the contact 33 is an electrical contact plate 45 that includes side notches 47 so that the plate 45 will register within a notch 49 in the center contact upper end 43.

The stem portion 37 of the actuator member 15 is bendable with respect to its longitudinal axis but has a fixed overall length. In order to provide the unique toggle action of the invention, the unbent length of the stem portion 37 between the pivot 19 and the bottom of the stem flange portion 39 is more than the distance between the pivot hole 19 in the housing 13 and the upper side of the plate 45 resting on the center contact 33. This configuration causes a normal bowing of the stem portion, either to one side or to the other (as seen in FIGS. 3 and 5), depending on which of the lobes 17 has been pushed downwardly toward the housing. The two positions shown in these figures depict the two stable (toggled) positions of the switch actuator member 15.

In the configuration shown in FIG. 3, the right side 51 of the stem flange portion 39 forces the right side 53 of the contact plate 45 to come into positive electrical contact with the upper end 55 of the right-most electrical contact 35 so as to complete an electrical circuit between the center contact 33 and the contact 35. On the other hand, by pressing the right-most lobe 17 down, the stem portion 37 is caused to bow to the left and assume the stable configuration illustrated in FIG. 5. Here, the left side 57 of the stem flange portion 39 forces the left side 59 of the contact plate 45 to complete an electrical circuit between the center contact 33 and the upper end 61 of the left electrical contact 31.

When the switch 11 is caused to move from one of its stable conditions to the other by pressing downwardly on a raised one of the two lobes 17, the stem portion 37 takes on a non-stable more complex curvature than the smooth bow-shaped curve shown in FIGS. 3 and 5. For example, FIG. 4 illustrates such a possible complex curvature. In this case, the removal of pressure on a lobe while the actuator member 15 is approximately in the middle of its rotation, will cause the actuator to snap back to its previous position and the previous electrical circuit will not be broken. However, if the rocker is rotated somewhat more than half way to the opposite side, the stem portion will snap over to its other stable configuration, breaking its original circuit and making a new electrical circuit involving the electrical contact on the opposite side of the center contact. Of course, it should be realized that more than one center electrical contact (in the same plane) may be utilized with more associated contacts on each side thereof so as to provide more than one electrical pole for switching purposes. Thus the contact plate may have an insulated central portion or separated but parallel contact plates may be utilized to provide a plurality of switchable electrical poles.

In accordance with another embodiment of the present invention illustrated in FIGS. 6–8, there is shown a paddle-type actuator toggle switch 71 constructed in accordance the the present invention. Instead of the rocker portion of the previously described embodiment, this embodiment provides an upper paddle portion 73 which extends above the pivot 19'. Also, in this embodiment, the switch housing 13' includes conventional flanges 75 with mounting holes 77 in order to attach the switch 71 to a panel (not shown).

The embodiment also illustrates a modified contact plate 45' which includes straight end portions 53' instead of the curved end portions 53 shown in FIGS. 2–5. Of course, the curved contact plate in the first embodiment may be used in this latest embodiment, and visa versa. And the same exchange can be made with respect to the switch housings and actuating members.

From the foregoing, it should be evident that there has herein been described a new and improved electrical toggle switch which is simple in construction, uses fewer parts than prior art toggle type switch, but which is more reliable in operation and which is less costly to manufacture.

Although specific embodiments of the present invention have been described in detail, it should be understood that other embodiments may be constructed which fall within the contemplation and scope of this invention. Also, it should be clear that the materials specified in this description are not critical and any material that has similar properties or characteristics may be utilized. Thus, the actuator member may be fabricated from a non-synthetic material such as pure rubber or a compound thereof. Also, the electrical conductive members of the present toggle switch may be made from any suitable material such as copper, brass, bronze, aluminum, steel, silver, gold or platinum, to mention only a few suitable materials, and any such material may be coated or plated with any other conductive material if desired. Further, the conductive terminals of the invention may be of any conventional design including, for example, terminals which include gripping devices into which external electrical wires are inserted.

What is claimed is:

1. An electrical toggle switch, comprising:

a switch housing including a mounting portion;

a plurality of spaced electrical switch contacts mounted in said switch housing;

a conductive contact member pivotally mounted in said housing on a first of said switch contacts and movable to either of two opposite pivotal positions to selectively make electrical contact with others of said contacts on opposite sides of said first switch contact;

a switch lever having two operating positions and including a manipulatable portion, a lower end portion operatively coupled to said conductive contact member opposite said first switch contact, and an intermediate pivot operatively coupled to said switch housing, that portion of said lever between said pivot and said lower end portion being resiliently bendable and having two oppositely bowed stable postions and an unstable range of positions intermediate said stable positions, each of said stable positions corresponding to a different one of said switch lever operating positions, the movement of said switch lever from one of said operating positions to the other thereof causing said contact member to move to a different one of said pivotal positions.

2. The electrical toggle switch according to claim 1, wherein said manipulatable portion of said switch lever is in a rocker configuration.

3. The electrical toggle switch according to claim 1, wherein said manipulatable portion of said switch lever is in a paddle configuration.

4. The electrical toggle switch according to claim 1, wherein said conductive contact member is pivotally supported at its center by the inner end of said first switch contact.

5. The electrical toggle switch according to claim 4, wherein the extremities of said conductive contact member are curved toward said mounting portion of said housing.

6. The electrical toggle switch according to claim 1, wherein said first switch contact includes a contact-receiving notch in its inner extremity, and said conductive contact member includes a notch which registers in said first switch contact notch to allow pivotal rotation of said conductive contact member but not lateral movement thereof relative to said first switch contact.

7. The electrical toggle switch according to claim 1, wherein said lower end portion of said switch lever includes a convex curve extremity, the apex of which is centered adjacent said first contact member, and the opposite sides of which alternately press an associated portion of said conductive contact toward an associated one of said contacts on opposite sides of said first switch contact.

8. An electrical toggle switch, comprising:

a switch housing including a mounting portion;

a plurality of spaced electrical switch contacts mounted in and extending within said switch housing and extending beyond said mounting portion externally of said housing;

a conductive contact member mounted in said switch housing and having an intermediate portion in pivotal and constant electrical contact with a first of said electrical switch contacts, the inner edge of said first of said electrical switch contacts acting as a fulcrum for the pivotal movement of said contact member between either of two pivotal positions, in each of said positions said first switch contact being in electrical contact with different ones of the other of said switch contacts through said contact member;

a manual toggle-acting actuation member pivotally mounted in said housing along a pivotal axis and including an inner end portion, an intermediate pivot portion and a manipulatable portion opposite said inner end portion, said inner end portion being in contact with said contact member opposite said first switch contact, the portion of said actuation member between said pivot portion and said inner end portion being bendable under force and having essentially a fixed length dimension and a natural tendency when bent to return to a rectilinear configuration, the distance between said pivotal axis and said inner end portion being less than said fixed length dimension, said bendable portion being forced by appropriate external force applied to said manipulatable portion into one of two stable but oppositely bowed configurations each of which being associated with a different one of said two pivotal positions of said contact member, said bendable portion assuming an unstable serpentine-like configuration when in transition between said two stable bowed configurations.

* * * * *